US011651921B2

(12) United States Patent
Greenwald et al.

(10) Patent No.: US 11,651,921 B2
(45) Date of Patent: May 16, 2023

(54) ELECTRICAL CONNECTOR WITH NON-LINEAR SPRING FORCE

(71) Applicant: ABB Schweiz AG, Baden (CH)

(72) Inventors: Steven Andrew Greenwald, Plainville, CT (US); Justin Daniel Dubrosky, Bristol, CT (US); Jamie Wakefield, Windsor, CT (US)

(73) Assignee: ABB SCHWEIZ AG, Baden (CH)

( * ) Notice: Subject to any disclaimer, the term of this patent is extended or adjusted under 35 U.S.C. 154(b) by 445 days.

(21) Appl. No.: 16/867,677

(22) Filed: May 6, 2020

(65) Prior Publication Data

US 2021/0350993 A1 Nov. 11, 2021

(51) Int. Cl.
*H01H 71/08* (2006.01)
*H01R 13/17* (2006.01)

(52) U.S. Cl.
CPC ..... *H01H 71/08* (2013.01); *H01R 13/17* (2013.01)

(58) Field of Classification Search
CPC .... H01R 13/17; H01R 13/193; H01R 25/142; H01R 25/145; H01R 13/03; H01R 13/18; H01R 13/2407; H01R 2101/00; H01R 13/20; H01H 71/08; H01H 71/0264
See application file for complete search history.

(56) References Cited

U.S. PATENT DOCUMENTS 3,848,948 A * 11/1974 Soes ..... H01R 13/193 439/252
4,157,582 A * 6/1979 Myers ..... H02B 1/056 361/636
4,416,504 A * 11/1983 Sochor ..... H01R 13/05 439/825
10,985,487 B2 * 4/2021 Tumu ..... H01R 25/142
2014/0160640 A1 6/2014 Duda et al.

FOREIGN PATENT DOCUMENTS

EP 3059814 A2 8/2016

* cited by examiner

*Primary Examiner* — Edwin A. Leon
(74) *Attorney, Agent, or Firm* — Greenberg Traurig, LLP

(57) ABSTRACT

Electrical connectors are provided for electrically coupling two electrical components. Opposing ends of the connector are coupled to each of the electrical components. At the first end, the connector is disposed in an opening of the first electrical component to establish electrical connection. The first end includes multiple contact portions that are biased with a non-linear spring force against the sides of the opening.

18 Claims, 6 Drawing Sheets

ELECTRICAL CONNECTOR WITH NON-LINEAR SPRING FORCE

BACKGROUND

The present inventions relate generally to an electrical connector, and more particularly, to an electrical connector coupling first and second electrical components together.

Typically, industrial facilities are provided with one or more power supply panels 10 to distribute electrical power throughout the industrial facility. An example of a power supply panel 10 is shown in FIGS. 1-2. As shown, the panel 10 includes an electrical box 12. Within the box 12, mounting structures 14 are also provided to mount a power supply bus 16 and a series of circuit breakers 18. Power is supplied to the bus 16 with one or more lugs 20 which are connected to electrical power supply cables and to the bus 16. The circuit breakers 18 are electrically connected to the bus 16 with an electrical connector 34 described in more detail below. Electrical cables are also connected to each circuit breaker 18 to supply electrical power to various electrical circuits throughout the industrial facility. Commonly, the total electrical capability of the power supply panel (i.e., the bus 16) is required to be within 150 A to 1,200 A. It is understood that the box 12 may also contain a variety of other electrical accessories in addition to the power supply bus 16 and circuit breakers 18. Although the described arrangement may be used with a single phase system, the illustrated system is a three-phase system. Thus, three lugs 20 are provided to supply power; three connecting slots 22 are provided in the bus 16; and each circuit breaker 18 has three output connectors 24. A cover 26 is also typically provided to enclose the bus 16 and other electrical hardware within the box 12.

SUMMARY

Improved electrical connectors are described for connecting a circuit breaker to a power supply bus. The power supply bus has an opening through which the connector is inserted to establish an electrical connection. The electrical connector includes first and second contact portions that contact first and second sides of the opening. A spring applies a bias force to the contact portions to press the contact portions against the sides of the opening. The spring force of the connector is non-linear so that the spring force of the connector stays within the desired spring force over a greater range of compressions.

BRIEF DESCRIPTION OF SEVERAL VIEWS OF THE DRAWINGS

The invention may be more fully understood by reading the following description in conjunction with the drawings, in which.

DETAILED DESCRIPTION

Figure 1:
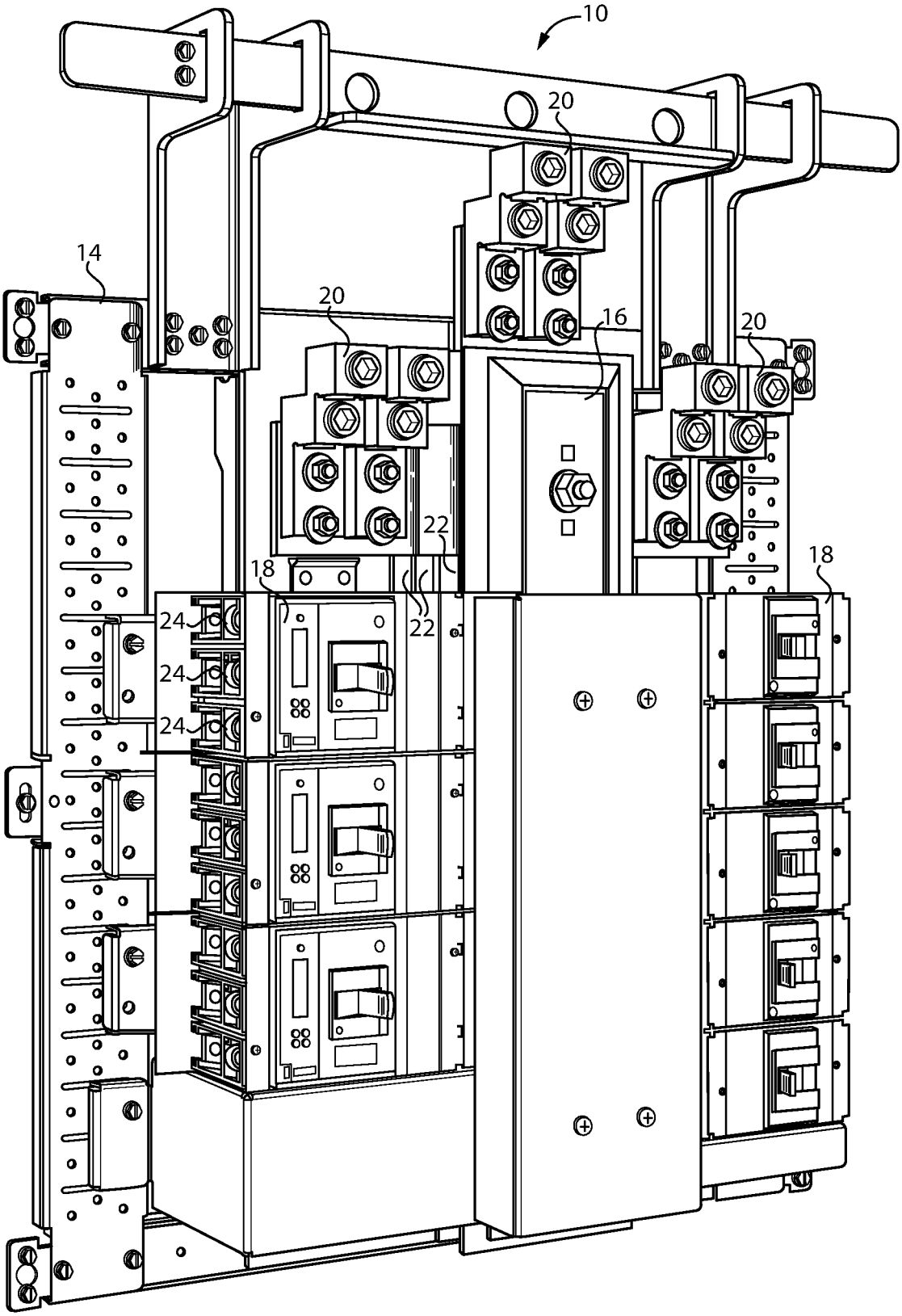
FIG. 1 (PRIOR ART)
FIG. 1 is a perspective view of the internal portion of a power supply panel.
Figure 2:
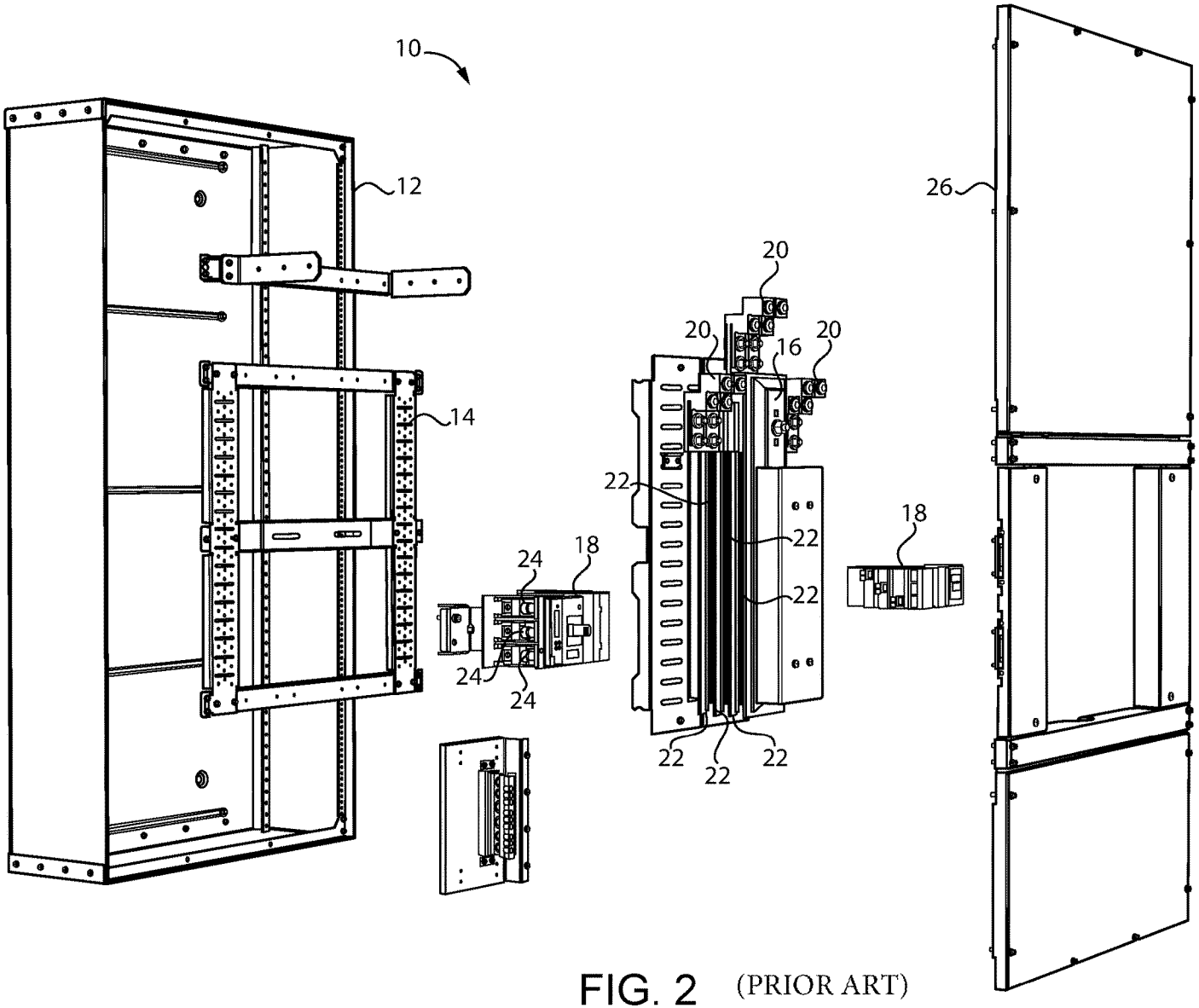
FIG. 2 (PRIOR ART)
FIG. 2 is an exploded view of the power supply panel.
Figure 3:
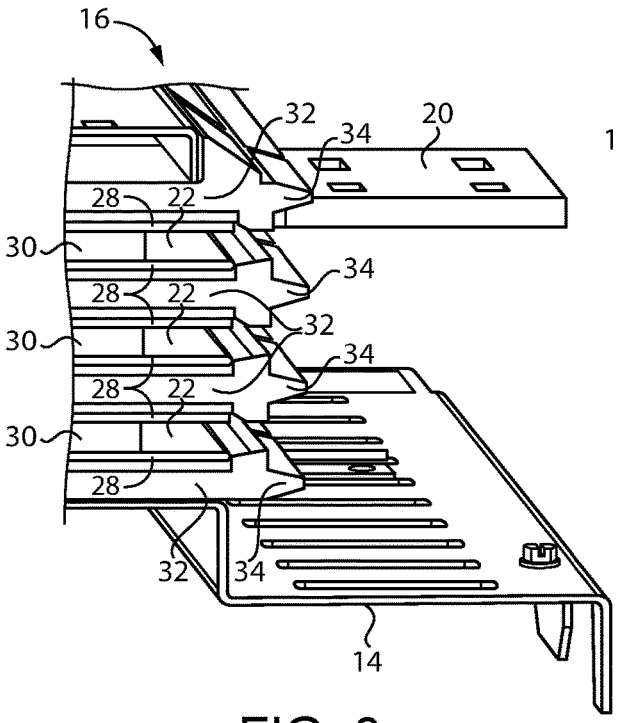
FIG. 3 is a cross-sectional view of a power supply bus of the power supply panel.

The power supply bus 16 is shown in cross-section in FIG. 3. As shown in FIG. 1, the circuit breaker 18 and bus 16 are mounted to the base 14 of the box 12. The bus 16 is preferably a stacked arrangement with a connecting slot 22 (i.e., an opening 22) between two contact plates 28 for each phase. The contact plates 28 are separated from each other with a spacer 30. In high amperage applications, it is preferred that both contact plates 28 defining a slot 22 are made of a conductive material like copper and the spacer 30 therebetween is also conductive. It is understood that other electrically conductive materials may also be used including, for example, aluminum. However, it may be possible in lower amperage applications for only one of the two plates 28 to be conductive and for the spacer 30 and the other plate 28 to be made of an insulative material. On the top and bottom of each plate 28, an insulated plate 32 is preferably provided. The insulated plate 32 may be made of fiber reinforced plastic. As shown, the insulated plates 32 preferably include an extension portion 34 that extends outward beyond the respective plate 28 and covers a portion of the respective connector 76, 82.

As shown, three electrical connectors 76 (or 82) are provided between the bus 16 and the circuit breaker 18, since the illustrated system is a three-phase system. In a single phase system, there would only be one connector 76, 82 between the bus 16 and the circuit breaker 18. The connector 76, 82 may be used with a variety of circuit breakers 18 having 1, 2, 3 or 4 poles. Each connector 76, 82 is coupled at a first end 36 to a respective connecting slot 22 of the bus 16 and at a second end 38 to the circuit breaker 18. In use, the connectors 76, 82 are preferably attached to the circuit breaker 18 by the manufacturer and supplied with the circuit breaker 18. When the circuit breaker 18 is installed into the box 12, the first end 36 of each connector 76, 82 slides into the respective connecting slot 22 of the bus 16 to electrically interconnect the bus 16 and the circuit breaker 18.

Figure 4:
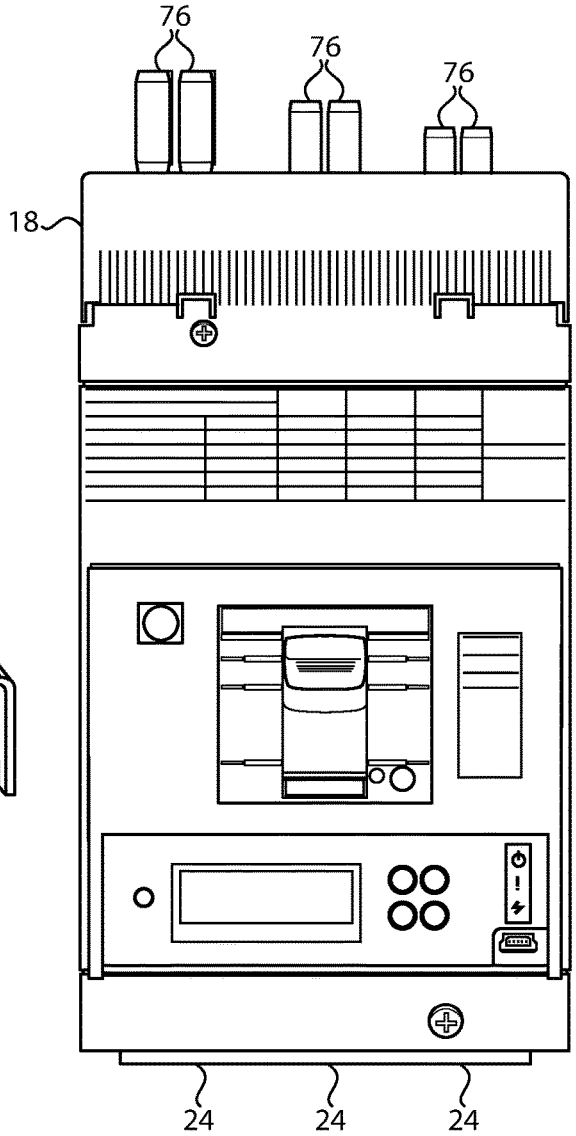
FIG. 4 is a front view of a circuit breaker.
Figure 5:
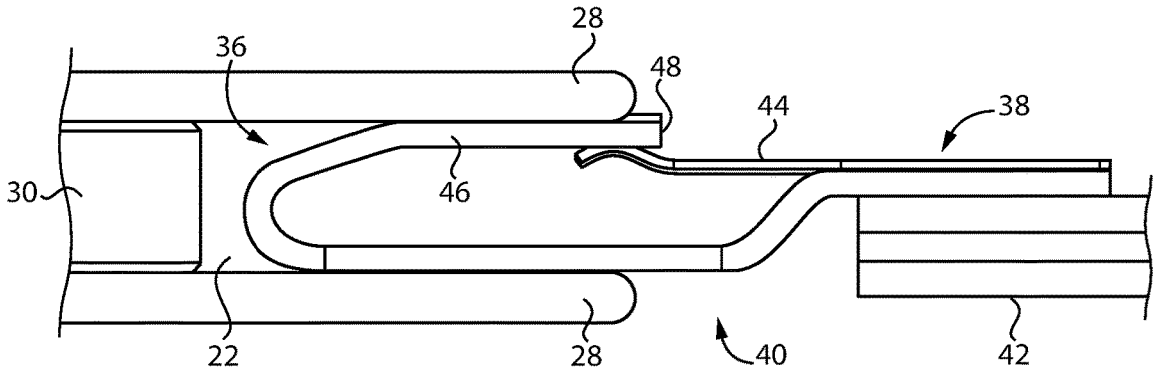
Prior Art FIG. 5
FIG. 5 is a side view of a prior art electrical connector.
Figure 6:
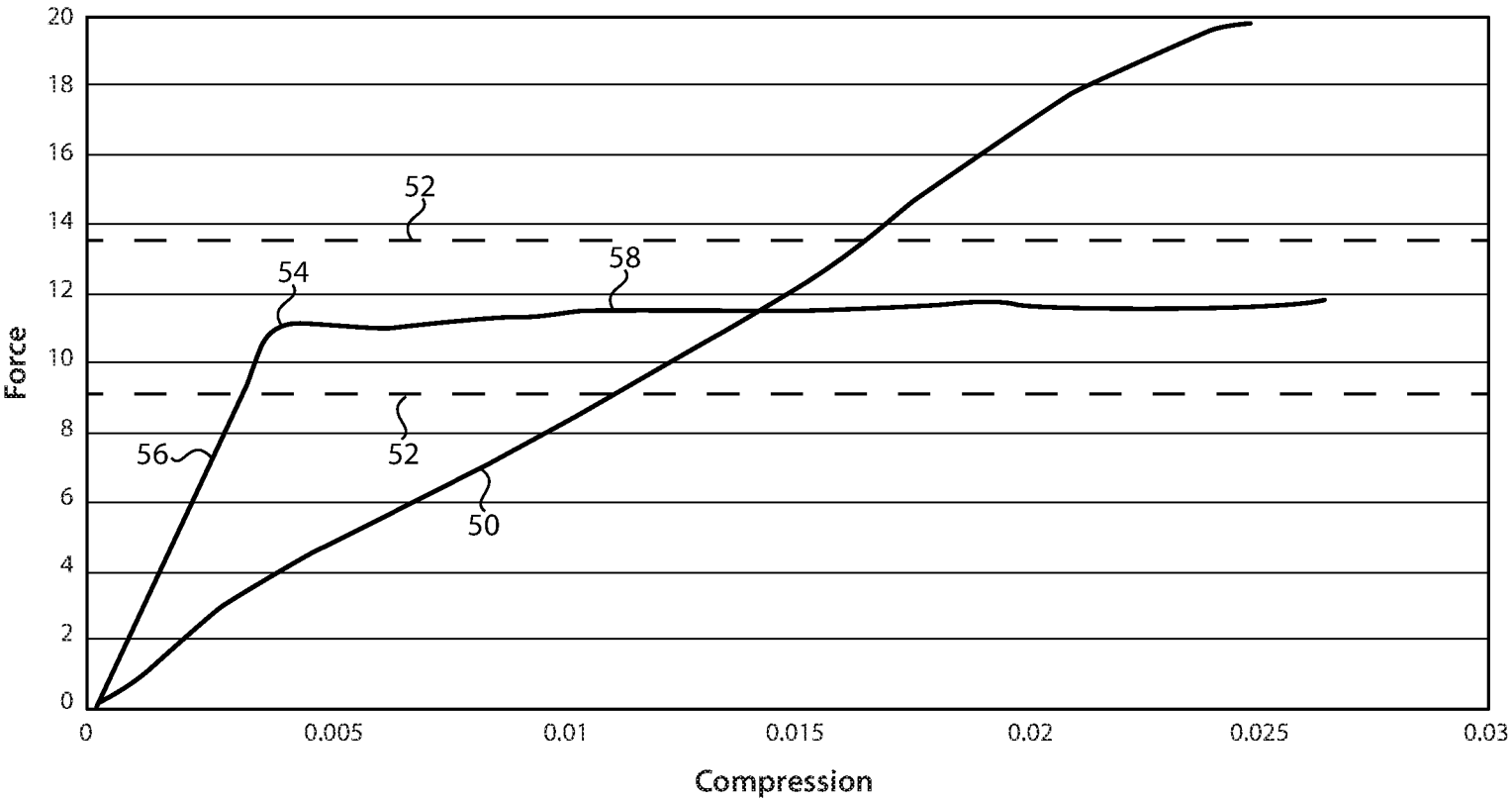
FIG. 6 is a chart showing the spring force of different electrical connectors.

A prior art connector 40 is shown in FIG. 5 that may be used with the circuit breaker 18 of FIG. 4 (in place of the improved connectors 76, 82) to connect the circuit breaker 18 to the power supply bus 16. As shown, the connector 40 is rigidly attached at the second end 40 to a bar 42. Although not illustrated, the bar 42 is attached to the circuit breaker 18 with bolts, rivets or some other type of rigid connection (see holes 74 in FIGS. 7-8). The first end 36 slides into the connection slot 22 in the power supply bus 16 in order to electrically connect the circuit breaker 18 to the bus 16. A cantilevered spring 44 may be provided which is rigidly attached to the second end 40 and contacts the inner side of a second arm 46 with a free end 48 to apply an outward force thereto. As shown in FIG. 6, the connector 40 of FIG. 5 exerts a linear spring force 50 as it is compressed. This may be a disadvantage because only a small range of compression of the connector 40 results in a spring force within the desirable range 52. That is, there is a substantial range of initial compression that is below the desirable range 52 where the connector 40 may not exert sufficient contact force against the contact plates 28. There is also a substantial range of compression that is above the desirable range 52 where the connector 40 may exert excessive contact force against the contact plates 28 which may make insertion and removal of the connector 40 from the bus 16 difficult.

As shown in FIG. 6, the improved electrical connectors 76, 82 exert a non-linear spring force 54 against the opening 22 (i.e., the contact plates 28) as the connectors 76, 82 are inserted into the bus 16. For example, in a first stage 56 of compression, the spring rate of the connector 76, 82 is greater than the spring rate of the connector 76, 82 in a second stage 58. In this example, the first stage 56 covers compressions of the connector 76, 82 that are less than the compressions in the second stage 58. That is, when the connector 76, 82 is initially compressed, the spring rate is high and the exerted spring force increases quickly. However, after the initial compression, the spring rate transitions to a lower spring rate so that the spring force increases at a slower rate as the connector 76, 82 is further compressed. Thus, the spring force flattens out in the second stage 58 to allow the exerted spring force to stay within the desired range 52 over a greater range of compressions compared to the linear spring force 50 of the prior art connector 40. Desirably, the first stage 56 is defined by compressions of the connector 76, 82 of less than 0.005 inch, while the second stage 58 is defined by compressions of the connector 76, 82 between 0.010 inch and 0.025 inch.

Figure 7:
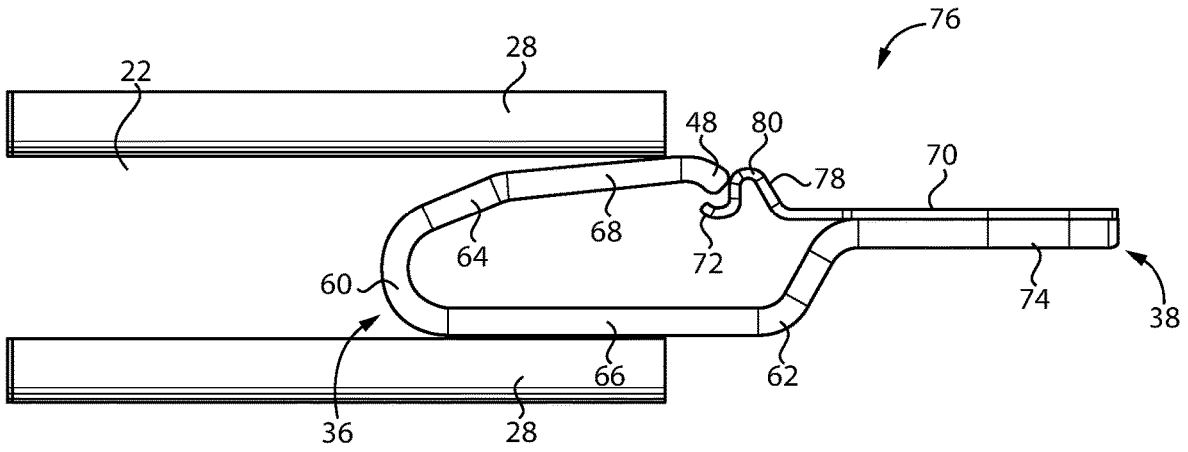
FIG. 7 is a side view of an improved electrical connector.
Figure 8:
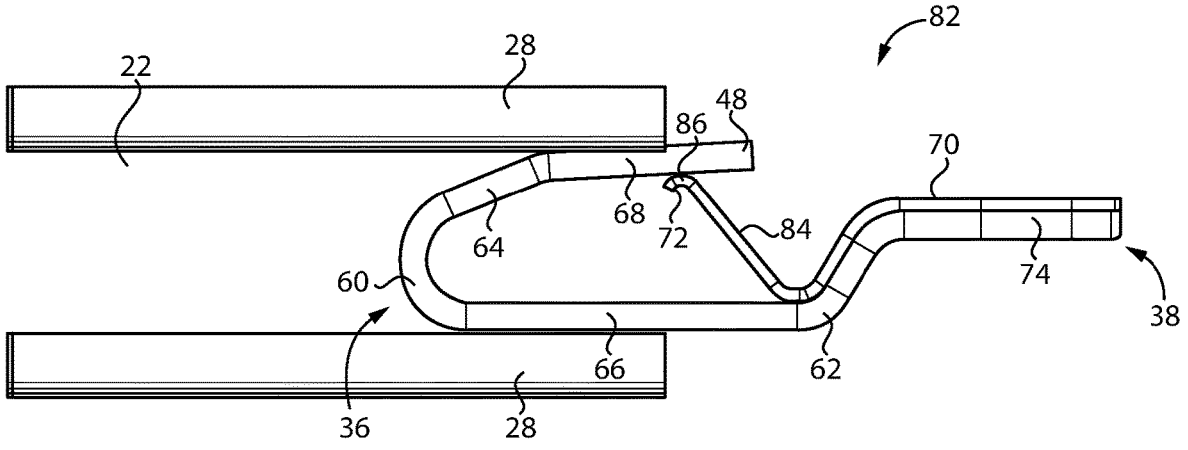
FIG. 8 is a side view of another improved electrical connector.

Turning to FIGS. 7-8, the improved electrical connectors 76, 82 have a first end 36 that is inserted into one of the connecting slots 22 of the bus 16 to connect a circuit breaker 18 to the bus 16. The second end 38 of the connector 76, 82 is connected to the circuit breaker 18 (e.g., with a bolt or rivet through a hole 74 in the second end 38). The first end 36 has a bend 60 between two arms 62, 64 of the connector 76, 82, with the first arm 62 defining the second end 38 of the connector 76, 82 and the second arm 64 defining a free end 48 of the connector 76, 82. First and second contact portions 66, 68 are located between the bend 60 and the second end 38 and the free end 48, respectively. When the connectors 76, 82 are inserted into the bus, the first and second contact portions 66, 68 are compressed against each other by the plates 28. The first contact portion 66 may be parallel with the plates 28, while the second contact portion 68 may be angled in the free state so that it is angled inward toward the bend 60 and outward toward the free end 48.

The connectors 76, 82 may also have a spring 78, 84 that engages the second arm 64 to bias the second arm 64 outward. For instance, the spring 78, 84 may be located between the first and second arms 62, 64. Most preferably, the spring 78, 84 may be a cantilevered spring 78, 84 with a first end 70 that is connected to the first arm 62 and a second free end 72 extending toward the second arm 64. The first end 70 may be connected to the second end 38 of the connector 76, 82 with the hole 74 and a bolt or rivet therethrough. Desirably, the first and second arms 62, 64 of the connector 76, 82 are made of copper while the spring 78, 84 is made of steel.

As shown in FIG. 7, in one connector 76, the spring 78 may have a hook 80 extending toward the free end 48 of the second arm 64. The hook 80 may be spaced apart from the free end 48 of the second arm 64 in the free state before the connector 76 has been compressed. After the connector 76 has been partially compressed (i.e., the first stage). The free end 48 of the second arm 64 may engage the hook 80 of the spring 78 so that the spring 78 provides greater resistance to further compression (i.e., the second stage). Thus, the spring 78 provides a buttressing force in the second stage such that the bend 60 between the first and second arms 62, 64 and the spring 78 both elastically flex to produce a combined spring force that is flatter than the first stage.

Figure 9:
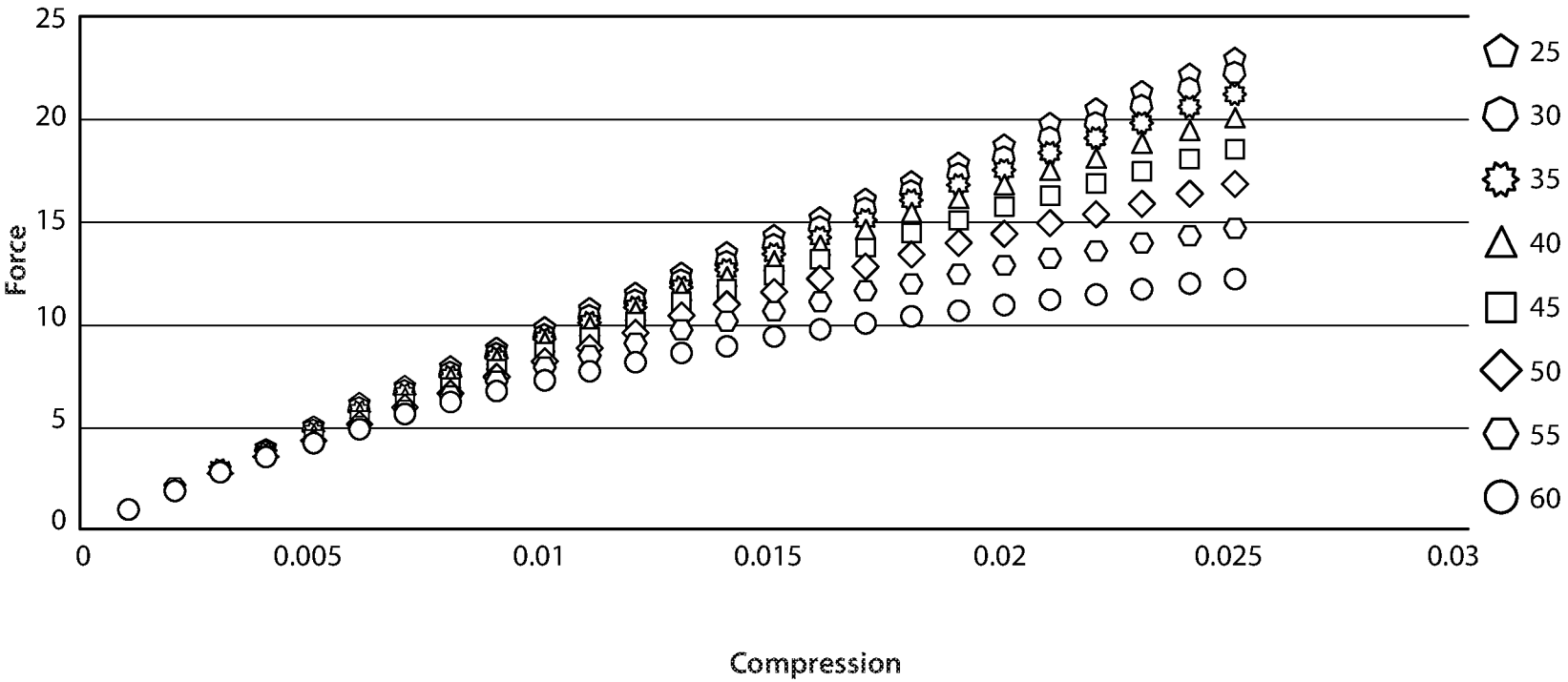
FIG. 9 is a chart showing the spring force of different angles for the spring of FIG. 8.

As shown in FIG. 8, in another connector 82, the spring 84 may be angled between the first and second arms 62, 64. Like the connector 76 of FIG. 7, the first end 70 of the spring 84 may be connected to the second end 38 of the connector 82. However, the spring 84 may follow the shape of the first arm 62 down to the inner surface of the first contact portion 66 where the spring 84 is angled upward toward the second contact portion 68. Thus, the spring 84 may extend at an angle between the first and second contact portions 66, 68 to engage the inner sides of the contact portions 66, 68. The second end 72 which contacts the second arm 64 may have a bend 86 contacting the inner side thereof. The combined spring force of the connector bend 60 and the spring 84 may result in a non-linear spring force as illustrated in FIG. 9. As shown, the spring force of the connector 82 in FIG. 8 varies depending on the angle of the spring 84 from a vertical line. For example, the spring force of the connector 82 is more non-linear when the angle of the spring 84 is 60° from vertical than when the spring 84 is angled 25° from vertical. Preferably, the spring 84 is angled 25° or more from vertical, and more preferably, 45° or more from vertical. Preferably, the spring 84 is not angled more than 75° from vertical.

While preferred embodiments of the inventions have been described, it should be understood that the inventions are not so limited, and modifications may be made without departing from the inventions herein. While each embodiment described herein may refer only to certain features and may not specifically refer to every feature described with respect to other embodiments, it should be recognized that the features described herein are interchangeable unless described otherwise, even where no reference is made to a specific feature. It should also be understood that the advantages described above are not necessarily the only advantages of the inventions, and it is not necessarily expected that all of the described advantages will be achieved with every embodiment of the inventions. The scope of the inventions is defined by the appended claims, and all devices and methods that come within the meaning of the claims, either literally or by equivalence, are intended to be embraced therein.

The invention claimed is:

1. An electrical connector electrically coupling a first electrical component and a second electrical component, comprising:

a first end electrically coupled to the first electrical component; and a second end electrically coupled to the second electrical component;

wherein the first electrical component comprises an opening defining an electrical contact;

wherein the first end is disposed within the opening and comprises first and second contact portions, and the first end comprises a bend disposed within the opening, a first arm and a second arm connected to opposite ends of the bend, wherein the first arm comprises the first contact portion and the second end, wherein the first contact portion is disposed between the bend and the second end, wherein the second arm comprises the second contact portion and a free end, and wherein the second contact portion is disposed between the bend and the free end, wherein the first contact portion is biased against a first side of the opening, and wherein the second contact portion is biased against a second side of the opening;

wherein the first and second contact portions apply a non-linear spring force against the opening.

2. The electrical connector according to claim 1, wherein the non-linear spring force comprises a first stage with a first spring rate and a second stage with a second spring rate, the first stage being defined by compressions of the first and second contact portions towards each other which are less than compressions in the second stage, and the first spring rate is greater than the second spring rate.

3. The electrical connector according to claim 2, wherein the first stage is defined by compressions of the first and second contact portions towards each other of less than 0.005 inch and the second stage is defined by compressions of the first and second contact portions towards each other of between than 0.010 inch and 0.025 inch.

4. The electrical connector according to claim 1, further comprising a spring disposed between the first and second arms and biasing the first and second contact portions away from each other.

5. The electrical connector according to claim 4, wherein the bend and the first and second arms are made of copper and the spring is made of steel.

6. The electrical connector according to claim 4, wherein the spring engages the first or second arm after a first stage of compression of the first and second contact portions, the spring thereby applying a greater spring force to the first and second contact portions in a second stage of compression after the first stage.

7. The electrical connector according to claim 4, wherein the spring is a cantilevered spring with a first end connected to the first or second arm and a second free end extending therefrom.

8. The electrical connector according to claim 7, wherein the cantilevered spring engages the first or second arm after a first stage of compression of the first and second contact portions, the cantilevered spring thereby applying a greater spring force to the first and second contact portions in a second stage of compression after the first stage.

9. The electrical connector according to claim 7, wherein the cantilevered spring is connected to the first arm and comprises a hook extending toward the free end of the second arm, the free end of the second arm engaging the hook of the cantilevered spring after a first stage of compression of the first and second contact portions, the cantilevered spring thereby applying a greater spring force to the first and second contact portions in a second stage of compression after the first stage.

10. The electrical connector according to claim 7, wherein the cantilevered spring is angled between the first and second arms.

11. The electrical connector according to claim 10, wherein the cantilevered spring is connected to the first arm and comprises a bend contacting an inner side of the second arm.

12. The electrical connector according to claim 10, wherein the cantilevered spring is angled 25° or more from vertical.

13. The electrical connector according to claim 10, wherein the cantilevered spring is angled 45° or more from vertical and not more than 75° from vertical.

14. The electrical connector according to claim 1, wherein the first electrical component is a power supply bus.

15. The electrical connector according to claim 14, wherein the second electrical component is a circuit breaker.

16. The electrical connector according to claim 15, wherein the power supply bus is a three phase power supply bus and the circuit breaker is a three phase circuit breaker, and comprising three of the electrical connectors, each of the electrical connectors electrically coupling one of the three phases between the power supply bus and the circuit breaker.

17. The electrical connector according to claim 1, wherein the opening of the first electrical component is a space between two parallel plates, the two parallel plates comprising the first and second sides of the opening.

18. The electrical connector according to claim 17, wherein the first electrical component is a power supply bus with an insulated plate disposed over at least one of the parallel plates, the insulated plate comprising an extension portion extending outward beyond the parallel plate.

* * * * *